United States Patent [19]

Goffinet

[11] 4,414,128

[45] Nov. 8, 1983

[54] LIQUID DETERGENT COMPOSITIONS

[75] Inventor: Pierre C. E. Goffinet, Brussels, Belgium

[73] Assignee: The Procter & Gamble Company, Cincinnati, Ohio

[21] Appl. No.: 271,165

[22] Filed: Jun. 8, 1981

[51] Int. Cl.[3] ..... C11D 3/44; C11D 10/04; C11D 17/08

[52] U.S. Cl. ..... 252/111; 252/106; 252/107; 252/114; 252/118; 252/122; 252/139; 252/153; 252/162; 252/170; 252/171; 252/173; 252/545; 252/546; 252/DIG. 14; 134/40

[58] Field of Search ..... 252/106, 107, 111, 114, 252/118, 122, 139, 153, 162, 170, 171, 545, 546, 173, DIG. 14; 134/40

[56] References Cited

U.S. PATENT DOCUMENTS

| | | | |
|---|---|---|---|
| Re. 29,649 | 5/1978 | Farnsworth | 252/171 |
| 2,073,464 | 3/1937 | Davey | 252/122 |
| 2,196,763 | 4/1940 | Figg | 252/122 |
| 2,437,857 | 3/1948 | Lister | 252/170 X |
| 2,710,843 | 6/1955 | Stebleton | 252/158 |
| 2,901,433 | 8/1959 | Spring | 252/114 |
| 3,367,878 | 2/1968 | Mankowich | 252/110 |
| 3,553,144 | 1/1971 | Murphy | 252/158 |
| 3,615,827 | 10/1971 | Murphy | 134/38 |
| 3,634,338 | 1/1972 | Laugle | 252/525 |
| 3,664,962 | 3/1972 | Kelly et al. | 252/125 |
| 3,872,021 | 3/1975 | McKnight | 252/121 |
| 3,882,038 | 5/1975 | Clayton et al. | 252/164 |
| 4,175,062 | 11/1979 | Disch et al. | 252/540 |

FOREIGN PATENT DOCUMENTS

| | | | |
|---|---|---|---|
| 2113732 | 9/1972 | Fed. Rep. of Germany . | |
| 2709690 | 5/1978 | Fed. Rep. of Germany . | |
| 54-14406 | 2/1979 | Japan . | |
| 56-22397 | 3/1981 | Japan . | |
| 1308190 | 2/1973 | United Kingdom . | |
| 2033421 | 5/1980 | United Kingdom | 252/162 |
| 1603047 | 11/1981 | United Kingdom . | |

OTHER PUBLICATIONS

Union Carbide Bulletin, "Glycol Ethers for Household and Institutional Products", 1976, 14 pp.

*Primary Examiner*—Dennis L. Albrecht

[57] ABSTRACT

Liquid detergent compositions, particularly for use as hard surface cleaners, comprising 1%–20% surfactant, 0.5%–10% mono- or sesquiterpenes, and 0.5%–10% of a polar solvent having a solubility in water of from 0.2% to 10%, preferably benzyl alcohol. The compositions provide excellent cleaning of both greasy and particulate soils, improved surface appearance, excellent formulation homogeneity, stability and viscosity characteristics as well as good suds control.

23 Claims, No Drawings

LIQUID DETERGENT COMPOSITIONS

TECHNICAL FIELD

This invention relates to liquid detergent compositions. In particular, it relates to aqueous detergent compositions suitable for use as general purpose household cleaning compositions.

BACKGROUND

General purpose household cleaning compositions for hard surfaces such as metal, glass, ceramic, plastic and linoleum surfaces, are commercially available in both powdered and liquid form. Powdered cleaning compositions consist mainly of builder or buffering salts such as phosphates, carbonates, silicates etc., and although such compositions may display good inorganic soil removal, they are generally deficient in cleaning ability on organic soils such as the grease/fatty/oily soils typically found in the domestic environment.

Liquid cleaning compositions, on the other hand, have the great advantage that they can be applied to hard surfaces in heat or concentrated form so that a relatively high level of surfactant material is delivered directly to the soil. Moreover, it is a rather more straightforward task to incorporate high concentrations of anionic or nonionic surfactant in a liquid rather than a granular composition. For both these reasons, therefore, liquid cleaning compositions have the potential to provide superior grease and oily soil removal over powdered cleaning compositions.

Nevertheless, liquid cleaning compositions still suffer a number of drawbacks which can limit their consumer acceptability. Thus, they generally contain little or no detergency builder salts and consequently they tend to have poor cleaning performance on particulate soil and also lack "robustness" under varying water hardness levels. In addition, they can suffer problems of product form, in particular, inhomogeneity, lack of clarity, or inadequate viscosity characteristic for consumer use. Moreover, the higher inproduct and in-use surfactant concentration necessary for improved grease handling raises problems of extensive suds formation requiring frequent rinsing and wiping on behalf of the consumer. Although oversudsing may be controlled to some extent by incorporating a suds-regulating material such as hydrophobic silica and/or silicane or soap, this in itself can raise problems of poor product stability and homogeneity and also problems associated with deposition of insoluble particulate or soap residues on the items or surfaces being cleaned, leading to filming, streaking and spotting.

It has now been discovered, however, that these defects of prior art liquid cleaning composition can be minimized or overcome through the incorporation therein of a specified level of mono- or sesquiterpene material in combination with a polar solvent of specified water-solubility characteristics. Although the terpenes, as a class, have limited water-solubility, it has now been found that they can be incorporated into liquid cleaning compositions in homogeneous form, even under "cold" processing conditions, with the ability to provide excellent cleaning characteristics across the range of water hardness or grease/oily soils and inorganic particulate soils, as well as on shoe polish, marker ink, bath tub soil etc, and excellent shine performance with low soil redeposition and little or no propensity to cause filming, streaking or spotting on surfaces washed therewith.

Moreover, the terpenes herein specified, and in particular those of the hydrocarbon class, are valuable in regulating the sudsing behavious of the instant compositions in both hard and soft water and under both diluted and neat or concentrated usage, while terpenes of the terpene alcohol class are also valuable for providing effective control of product viscosity characteristics.

Terpenes are, of course, well-known components of perfume compositions and are often incorporated into detergent compositions at low levels via the perfume. Certain terpenes have also been included in detergent compositions at higher levels; for instance, German patent application No. 2,113,732 discloses the use of aliphatic and alicyclic terpenes as anti-microbial agents in washing compositions, while British Pat. No. 1,308,190 teaches the use of dipentene in a thixotripic liquid detergent suspension base composition. German patent application No. 2,709,690 teaches the use of pine oil (a mixture mainly of terpene alcohols) in liquid hard surface cleaning compositions. There has apparently been no disclosure, however, of the combined use of a terpene cleaning agent with a polar solvent of low-water solubility.

The present invention thus provides liquid detergent compositions which are stable homogeneous fluent liquids having excellent suds control across the range of usage and water hardness conditions and which provide excellent shine performance together with improved cleaning characteristics both on greasy/oily soils and on inorganic particulate soils with little tendency to cause filming or streaking on washed surfaces.

SUMMARY OF THE INVENTION

According to the present invention there is provided an aqueous liquid detergent composition characterized by:

(a) from about 1% to about 20% of a synthetic anionic, nonionic, amphoteric or zwitterionic surfactant or mixture thereof, (b) from about 0.5% to about 10% of a mono-or sesquiterpene or mixture thereof, the weight ratio of surfactant:terpene lying in the range of 5:1 to 1:3 and (c) from about 0.5 to about 10% of a polar solvent having a solubility in water at 25° C. in the range from about 0.2% to about 10%.

Preferred terpenes are mono- and bicyclic monoterpenes, especially those of the hydrocarbon class, which can be selected from terpinenes, terpinolenes, limonenes and pinenes. Highly preferred materials of this type include d-limonene, dipentene, α-pinene, β-pinene and the mixture of terpene hydrocarbons obtained from the essence of oranges (eg. cold-pressed orange terpenes and orange terpene oil phase ex fruitjuice). Terpene alcohols, aldehydes and ketones can also be used, however, the alcohols, in particular, providing valuable but unexpected improvements in viscosity regulation when incorporated in the compositions of the invention at a level, preferably, of from about 1% to about 3%, more preferably from about 1.5% to about 2.5%. The terpene is used in combination with a polar solvent (i.e. containing at least one hydrophilic group) having a solubility in water of from about 0.2% to about 10% by weight (g/100 g solution), preferably from about 0.5% to about 6% by weight, for example benzyl alcohol. The compositions of the invention also preferably contain from about 0.005% to about 2%, more preferably from about 0.05% to about 0.7% of an alkali metal, ammonium or alkanolammonium soap of a $C_{13}$–$C_{24}$, especially $C_{13}$–$C_{18}$, fatty acid. Preferably, the fatty acid is fully saturated, for example, by hydrogenation of naturally occurring fatty acids. Addition of the soap, particularly to compositions containing terpene hydrocarbons, is found to provide significant synergistic enhancement in the suds-suppression effectiveness of the system.

A calcium sequestrant is also desirable in the present compositions, providing not only cleaning advantages on particulate soil, but also, surprisingly, advantages in terms of product homogeneity and stability. The sequestrant component is a water-soluble inorganic or organic polyanionic sequestrant having a calcium ion stability constant at 25° C. of at least about 2.0, preferably at least about 3.0, the weight ratio of surfactant:sequestrant preferably lying in the range from about 5:1 to about 1:3, especially about 3:1 to about 1:1. In preferred embodiments the sequestrant has an anion valence of at least 3 and is incorporated at a level of from about 0.5% to about 13% by weight. The composition itself preferably has a pH in 1% aqueous solution of at least about 8.0.

Suitably, the sequestrant can be selected from the water-soluble salts of polyphosphates, polycarboxylates, aminopolycarboxylates, polyphosphonates and amino polyphosphonates and added at a level in the range from 1 to 9%, especially 2 to 8%, more especially 3 to 7% by weight of the composition. Adjustment of the sequestrant level and surfactant:sequestrant ratio within the above specified ranges is important for providing composition of optimum stability.

A notable feature of the instant compositions is the suds-suppression effectiveness of the terpenes in liquid compositions based on ampholytic or zwitterionic surfactants. Thus, it is notoriously difficult to control the sudsing behaviour of these surfactants in a cost-effective manner using conventional suppression agents such as soaps, waxes etc. The terpenes are thus particularly valuable in this respect.

We will now discuss the individual components of the present compositions in more detail.

A wide range of anionic, nonionic, zwitterionic and amphoteric surfactants can be used in the present compositions. A typical listing of the classes and species of these surfactants is given in U.S. Pat. No. 3,663,961 issued to Norris on May 23, 1972 and incorporated herein by reference. These surfactants can be used singly or in combination at levels in the range from about 1% to about 20%, preferably at levels from about 3% to about 10% by weight of the compositions.

Suitable anionic non-soap surfactants are water-soluble salts of alkyl benzene sulfonates, alkyl sulfates, alkyl polyethoxy ether sulfates, paraffin sulfonates, alpha-olefin sulfonates, alpha-sulfocarboxylates and their esters, alkyl glyceryl ether sulfonates, fatty acid monoglyceride sulfates and sulfonates, alkyl phenol polyethoxy ether sulfates, 2-acyloxy-alkane-1-sulfonate, and beta-alkyloxy alkane sulfonate. Of all the above, the paraffin sulfonates are highly preferred.

A particularly suitable class of anionic detergents includes water-soluble salts, particularly the alkali metal, ammonium and alkanolammonium salts of organic sulfuric reaction products having in their molecular structure an alkyl or alkaryl group containing from about 8 to about 22, especially from about 10 to about 20 carbon atoms and a sulfonic acid or sulfuric acid ester group. (Included in the term "alkyl" is the alkyl portion of acyl groups). Examples of this group of synthetic detergents which form part of the detergent compositions of the present invention are the sodium and potassium alkyl sulfates, especially those obtained by sulfating the higher alcohols ($C_8$–$C_{18}$) carbon atoms produced by reducing the glycerides of tallow or coconut oil and sodium and potassium alkyl benzene sulfonates, in which the alkyl group contains from about 9 to about 15, especially about 11 to about 13, carbon atoms, in straight chain or branched chain configuration, e.g. those of the type described in U.S. Pat. No. 2,220,099 and 2,477,383 and those prepared from alkylbenzenes obtained by alkylation with straight chain chloroparaffins (using aluminium trichloride catalysis) or straight chain olefins (using hydrogen fluoride catalysis). Especially valuable are linear straight chain alkyl benzene sulfonates in which the average of the alkyl group is about 11.8 carbon atoms, abbreviated as $C_{11.8}$LAS.

Other anionic detergent compounds herein include the sodium $C_{10}$–$C_{18}$ alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic detergent compounds herein include the water-soluble salts or esters of $\alpha$-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 18, especially about 12 to 16, carbon atoms in the alkyl group and from about 1 to 12, especially 1 to 6, more especially 1 to 4 moles of ethylene oxide; water-soluble salts of olefin sulfonates containing from about 12 to 24, preferably about 14 to 16, carbon atoms, especially those made by reaction with sulfur trioxide followed by neutralization under conditions such that any sultones present are hydrolysed to the corresponding hydroxy alkane sulfonates; water-soluble salts of paraffin sulfonates containing from about 8 to 24, especially 14 to 18 carbon atoms, and $\beta$-alkyloxy alkane sulfonates containing from about 1 to 3 carbon atoms in the alkyl group and from about 8 to 20 carbon atoms in the alkane moiety.

The alkane chains of the foregoing non-soap anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Magnesium and calcium are preferred cations under circumstances described by Belgian Pat. No. 843,636 invented by Jones et al, issued Dec. 30, 1976. Mixtures of anionic surfactants are contemplated by this invention; a preferred mixture contains alkyl benzene sulfonate having 11 to 13 carbon atoms in the alkyl group or paraffin sulfonate having 14 to 18 carbon atoms and either an alkyl sulfate having 8 to 18, preferably 12 to 18, carbon atoms in the alkyl group, or an alkyl polyethoxy alcohol sulfate having 10 to 16 carbon atoms in the alkyl group and an average degree of ethoxylation of 1 to 6.

Suitable nonionic surfactants include alkoxylated nonionic surfactants and also those of a semi-polar character. Alkoxylated nonionic surfactant materials can be broadly defined as compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Examples of suitable nonionic surfactants include:

1. The polyethylene oxide condensates of alkyl phenol, e.g. the condensation products of alkyl phenols having an alkyl group containing from 6 to 12 carbon atoms in either a straight chain or branched chain configuration, with ethylene oxide, the said ethylene oxide being present in amounts equal to 5 to 25 moles of ethylene oxide per mole of alkyl phenol. The alkyl substituent in such compounds may be derived, for example, from polymerised propylene, diisobutylene, octene and nonene. Other examples include dodecylphenol condensed with 12 moles of ethylene oxide per mole of phenol; dinonylphenol condensed with 15 moles of ethylene oxide per mole of phenol; nonylphenol and di-iso-isooctylphenol condensed with 15 moles of ethylene oxide.

2. The condensation product of primary or secondary aliphatic alcohols having from 8 to 24 carbon atoms, in either straight chain or branched chain configuration, with from 1 to about 30 moles of alkylene oxide per mole of alcohol. Preferably, the aliphatic alcohol comprises between 9 and 15 carbon atoms and is ethoxylated with between 2 and 12, desirably between 3 and 9 moles of ethylene oxide per mole of aliphatic alcohol. Such nonionic surfactants are preferred from the point of view of providing good to excellent detergency performance on fatty and greasy soils, and in the presence of hardness sensitive anionic surfactants such as alkyl benzene sulfonates. The preferred surfactants are prepared from primary alcohols which are either linear (such as those derived from natural fats or, prepared by the Ziegler process from ethylene, e.g. myristyl, cetyl, stearyl alcohols), or partly branched such as the Dobanols and Neodols which have about 25% 2-methyl branching (Dobanol and Neodol being Trade Names of Shell) or Synperonics, which are understood to have about 50% 2-methyl branching (Synperonic is a Trade Name of I.C.I.) or the primary alcohols having more than 50% branched chain structure sold under the Trade Name Lial by Liquichimica. Specific examples of nonionic surfactants falling within the scope of the invention include Dobanol 45-4, Dobanol 45-7, Dobanol 45-9, Dobanol 91-3, Dobanol 91-6, Dobanol 91-8, Synperonic 6, Synperonic 14, the condensation products of coconut alcohol with an average of between 5 and 12 moles of ethylene oxide per mole of alcohol, the coconut alkyl portion having from 10 to 14 carbon atoms, and the condensation products of tallow alcohol with an average of between 7 and 12 moles of ethylene oxide per mole of alcohol, the tallow portion comprising essentially between 16 and 22 carbon atoms. Secondary linear alkyl ethoxylates are also suitable in the present compositions, especially those ethoxylates of the Tergitol series having from about 9 to 15 carbon atoms in the alkyl group and up to about 11, especially from about 3 to 9, ethoxy residues per molecule.

3. The compounds formed by condensing ethylene oxide with a hydrophobic base formed by the condensation of propylene oxide with either propylene glycol or ethylene diamine. Such synthetic nonionic detergents are available on the market under the Trade Names of "Pluronic" and "Tetronic" respectively supplied by Wyandotte Chemicals Corporation.

Of the above, highly preferred are alkoxylated nonionic surfactants having an average HLB in the range from about 9.5 to 13.5, especially 10 to 12.5. Highly suitable nonionic surfactants of this type are ethoxylated primary or secondary $C_{9-15}$ alcohols having an average degree of ethoxylation from about 3to 9, more preferably from about 5 to 8.

Suitable semi-polar surfactants are water-soluble amine oxides containing one alkyl moiety of from about 10 to 28 carbon atoms and 2 moieties selected from the group consisting of alkyl groups and hydroxyalkyl groups containing from 1 to about 3 carbon atoms, and especially alkyl dimethyl amine oxides wherein the alkyl group contains from about 11 to 16 carbon atoms; water-soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water-soluble sulfoxide detergents containing one alkyl moiety of from about 10 to 28 carbon atoms an a moiety selected from the group consisting of alkyl and hydroxyalkyl moieties of from 1 to 3 carbon atoms.

Suitable ampholytic surfactants are water-soluble derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g. carboxy, sulfonate, sulfate, phosphate, or phosphonate.

Suitable zwitterionic surfactants are water soluble derivatives of aliphatic quaternary ammonium phosphonium and sulfonium cationic compounds in which the aliphatic moieties can be straight chain or branched, and wherein one of the aliphatic substituents contains from about 8 to 18 carbon atoms and one contains an anionic water-solubilizing group.

Preferred amphoteric and zwitterionic surfactants have the general formula:

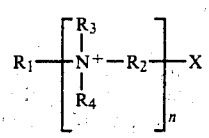

A wherein X is $CO_2^-$ or $SO_3^-$, $R_1$ is alkyl or alkenyl group having 8 to 22 carbon atoms, possibly interrupted by amide, ester or ether linkages, $R_2$ is a methylene, ethylene, propylene, isopropylene or isobutylene radical, $R_3$ and $R_4$ are independently selected from hydrogen, $C_{1-3}$ alkyl or —$R_2$—X, whereby one of the substituents $R_3$ and $R_4$ is hydrogen if the other one is represented by the group —$R_2$X, n is an integer from 1 to 6, and A is an equivalent amount of a neutralizing anion, except that amphoteric surfactants include amine salts of the above formula and also the corresponding free amines.

Highly preferred surfactants according to the above formula, include N-alkyl-2-aminopropionic acid, N-alkyl-2-imino-diacetic acid, N-alkyl-2-iminodipropionic acid, N-alkyl-2-amino-2-methyl-propionic acid, N-alkyl-propylenediaminepropionic acid, N-alkyl-dipropylenetriamine-propionic acid, N-alkyl-dipropylenetriamine dipropionic acid, N-alkylglycine, N-alkyl-amino-succinic acid, N-amidoalkyl- N'-carboxymethyl-N',N'-dimethyl-ammonio -ethylene diamine, N-alkyl-amino ethane-sulfonic acid, N-alky-N,N-dimethyl-ammonio-hydroxypropene-sulfonic acid and salts thereof, wherein alkyl represents a $C_8$ to $C_{18}$ alkyl group, especially coconut alkyl, lauryl and tallow alkyl. Specific examples include Armeen Z (marketed by Armour), Amphosol AA and SP (marketed by I.C.V.), Amphoram CPl, Diamphoram CPl, Triamphoram CPl, Triamphoram $C_2P_1$ and Polyamphorams CPl, $C_2P_1$ and $C_3P_1$ (marketed by Pierrefitte-Auby) and Deriphat 170C and Deriphat 154 (marketed by General Mills).

Of all the above surfactants, highly preferred compositions comprise as the single or major surfactant component, surfactants selected from the anionic, amphoteric and zwitterionic classes. The nonionic surfactants when present are preferably included in only a minor amount, i.e. at a level of about 5 to about 50% by weight of the surfactant system.

The sequestrant can be selected from the water-soluble salts of polyphosphates, polycarboxylates, aminopolycarboxylates, polyphosphonates and aminopolyphosphonates having a logarithmic calcium ion stability constant ($pK_{Ca++}$) of about 2 or greater and preferably an anion valence of at least 3. The stability constant is defined as follows:

$$pK_{Ca++} = \log_{10}K_{Ca++} \text{ where } K_{Ca++} = \frac{[Ca^{++}A^{(n-2)-}]}{[Ca^{++}][A^{n-}]}$$

and $A^{n-}$ is the ionic species of sequestrant which predominates at the in-use pH of the composition (defined as the pH of a 1% aqueous solution of the composition) and n is at least 3.

Preferably, the sequestrant has a $pK_{Ca++}$ in the range from about 2 to about 11, especially from about 3 to about 8. Literature values of stability constants are taken where possible (see Stability Constants of Metal-Ion Complexes, Special Publication No. 25, The Chemical Society, London); where doubt arises, the stability constant is defined at 25° C. and at zero ionic strength using a glass electrode method of measurement as described in Complexation in Analytical Chemistry by Anders Ringbom (1963).

Suitable polyphosphates include pyrophosphates such as tetrasodium pyrophosphate decahydrate, and tetrapotassium pyrophosphate; tripolyphosphates such as pentapotassium tripolyphosphate; and higher polyphosphates and metaphosphates such as sodium pentapolyphosphate and sodium hexametaphosphate.

The carboxylate-type sequestrants can be described as monomeric polycarboxylate materials or oligomers or polymers derived from carboxylate or polycarboxylate monomers. The sequestrants can be acyclic, alicyclic or aromatic in nature.

Suitable polycarboxylates include the salts of citric acid, aconitic acid, citraconic acid, carboxymethyloxy succinic acid, lactoxysuccinic acid, and 2-oxa-1,1,3-propane tricarboxylic acid; oxydisuccinic acid, 1,1,2,2-ethane tetra carboxylic acid, 1,1,3,3-propane tetracarboxylic acid and 1,1, 2,3-propane tetracarboxylic acid; cyclopentane-cis, cis, cis-tetracarboxylic acid, cyclopenta dienide pentacarboxylic acid, 2,3,4,5-tetrahydrofuran-cis, cis, cis-carboxylic acid, 2,5-tetrahydrofuran-cis-dicarboxylic acid, 1,2,3,4,5,6-hexane-hexacarboxylic acid, mellitic acid, pyromellitic acid and the phthalic acid derivatives disclosed in British Pat. No. 1,425,343.

Suitable polymeric polycarboxylates include homo- and copolymers of polycarboxyl monomers such as maleic acid, citraconic acid, aconitic acid, fumaric acid, mesaconic acid, phenyl maleic acid, benzyl maleic acid, itaconic acid and methylene malonic acid; homo- and copolymers of acrylic monomers such as acrylic acid, methacrylic acid or α-hydroxy acrylic acid; or copolymers of one or more of the above polycarboxyl and acrylic monomers with another unsaturated polymerizable monomer, such as vinyl ethers, acrylic esters, olefins, vinyl pyrrolidones and styrenes.

Suitable aminopolycarboxylates include especially the amino polyacetates, e.g. sodium, potassium, ammonium and alkanolammonium ethylenediamine tetraacetates, diethylene triamine pentaacetates and nitrilotriacetates.

Polyphosphonate and aminopolyphosphonate materials suitable for use herein can be exemplified by nitrilo tri(methylene phosphonic acid), ethylenediamine tetra (methylene phosphonic acid), diethylenetriamine penta (methylenephosphonic acid) and the water-soluable salts thereof.

The terpene component of the instant compositions belongs to the class of mono- or sesquiterpenes or mixtures thereof and can be acyclic or preferably monocyclic or bicyclic in structure. It is preferably liquid at room temperature (25° C.). Preferred terpenes belong to the class of terpene hydrocarbons and terpene alcohols. Examples of acyclic terpene hydrocarbons suitable for use herein include 2-methyl-6-methylene-2, 7-octadiene and 2,6-dimethyl-2,4,6-octadiene. Preferred monocyclic terpene hydrocarbons belong to the terpinene, terpinolene and limonene classes, for example, the α, β and γ-terpinenes, the d and 2-limonenes and dipentene (essentially a limonene racemate). The limonenes occur naturally in certain fruit and vegetable essences and a preferred source of limonene is the essence of orange and other citrus fruits. Preferred bicyclic terpene hydrocarbons include α and β-pinene. The terpene is added at a level of about 0.5% to about 10%, preferably 1% to about 5% by weight of the composition.

The terpene alcohol can be a primary, secondary or tertiary alcohol derivative of a cyclic or acyclic terpene hydrocarbon. Suitable tertiary alcohols include terpineol, usually sold commercially as a mixture of α,β and γ isomers and linalool; suitable secondary alcohols include borneol; suitable primary alcohols include geraniol. Complex mixtures of terpene alcohols are also suitable, especially the mixture of alcohols manufactured by distilling the oils extracted from pine wood, cones and needles and sold commercially as "pine oils". The terpene alcohol is preferably added at a level in the range from about 1% to about 3%, more preferably from about 1.5% to about 2.5% by weight of the compositions in order to provide optimum control of product viscosity characteristics. Preferably such compositions have a viscosity in the range from about 80 to 200 cp (0.08 to 0.2 Pa.s) measured in a Brookfield viscometer, using Spindle No. 2 at 60 r.p.m. and at 21° C.

The polar solvent component of the present compositions has a solubility in water at 25° C. in the range from about 0.2% to about 10%, preferably from about 0.5% to about 6%. The solvent contains at least one hydrophilic group and is liquid at room temperature. The solvent can be at a level of about 0.5% to about 10% especially 1% to about 5%, by weight of the composition and at a weight ratio of terpene:solvent in the range from about 5:1 to 1:5, especially 2:1 to 1:2. Highly preferred materials include aromatic alcohols such as benzyl alcohol, polyethoxylated phenols containing from 2 to 6 ethoxy groups and phenylethyl alcohol; esters of $C_1$–$C_6$ fatty acids with $C_1$–$C_6$ alcohols containing a total of from 5 to 9 carbon atoms, e.g., n-butyl butyrate, n-butyl propionate and n-propyl acetate; and mono $C_6$–$C_9$ and di-$C_4$–$C_9$ alkyl or aryl ethers of ethylene glycol such as hexyl, benzyl and phenyl Cellosolves (Registered Trade Mark) and ethyleneglycol dibutyl ether.

The compositions of the invention can be supplemented by all manner of detergent components compatible with a fluent, liquid system.

A non-aqueous solvent is a particularly suitable additional ingredient, especially water miscible or highly soluble (at least 20%w/w) aliphatic mono-, di- and tri alcohols. Specific examples are ethanol, propanol, isopropanol, and propane-1,3-diol. Other suitable solvents are ethylene-, propylene-, diethylene- and dipropylene glycol and the mono-$C_{1-4}$ alkyl ether and $C_{1-4}$ ester derivatives thereof such as the ethylene glycol monomethyl-, monoethyl- and monobutyl ethers, propylene glycol propyl ether, dipropylene glycol methyl ether, ethylene glycol mono acetate and ethylene glycol monoethyl ether acetate. The non-aqueous solvent can be added in amounts up to about 10%, preferably 6% by weight of the composition.

Hydrotropes such as urea, monoethanolamine, diethanolamine, triethanolamine and the sodium, potassium, ammonium and alkanol ammonium salts of xylene-, toluene-, ethylbenzene-, isopropyl-benzene sulfonates, can also be added to the compositions of the present invention in amounts up to about 10% by weight. It is a feature of the present invention, however, that stable, homogenous formulations can be prepared without the need for hydrotropic materials of this kind, or with only very minor levels (i.e. less than about 4% by weight).

Other suitable ingredients of the present compositions include pH buffering materials such as alkali metal and ammonium carbonates, bicarbonates, metasilicates and ortho phosphates. These can be added, if appropriate, at levels up to about 10% by weight to provide a compositional pH equal to or greater than about pH 8, preferably greater than about pH9 and more preferably greater than about pH10. Dyes, perfumes enzymes, chlorine-releasing agents, polypeptides and protein hydrolysates, soil suspending agents such as carboxy methylcellulose, hydroxymethyl cellulose and polyethylene glycols having a molecular weight of about 400 to about 10,000, fluorescers such as disodium 4,4'-bis(2-morpholino-4-anilinos-triazin-6-yl amino) stilbene-2,2'-disulfonate, preservatives such as Preventol ON marketed by Bayer, thickeners such as xanthan gum, and additional suds regulants such as tributylphosphate and silicone oil can all be included in the instant compositions.

A germicide such as o-phenyl phenate can also be added to the present compositions, providing excellent hard surface germicidal activity.

In the examples which follow, the abbreviations used have the following descriptions:

| | |
|---|---|
| PS | Sodium $C_{13}$ to $C_{16}$ paraffin sulfonate marketed by Hoechst under Trade Name Hostapur SAS. |
| LAS | Sodium salt of linear $C_{11.8}$ alkyl benzene sulfonate. |
| $AE_3S$ | Sodium linear $C_{12-14}$ alcohol sulfate including 3 ethylene oxide moieties. |
| Dobanol 91-8 | A $C_{9-11}$ oxo-alcohol with 8 moles of ethylene oxide, marketed by Shell. |
| Dobanol 45-7 | A $C_{14-15}$ oxo-alcohol with 7 moles of ethylene oxide, marketed by Shell. |
| Pluronic L-42 | A condensation product of ethylene oxide and propylene oxide, marketed by BASF-Wyandotte. |
| Deriphat 170C | N—$C_{12-14}$ alkyl-$\beta$-amino propionic acid marketed by General Mills. |
| Amphoram CP1 | N—cocoyl-$\beta$-amino propionic acid marketed by Pierrefitte-Auby. |
| Deriphat 154 | Disodium-N—tallow-$\beta$-amino propionate marketed by General Mills. |
| Ethylan HB-4 | Phenol ethoxylated with 4 moles of ethylene oxide, marketed by Diamond Shamrock. |
| HT Soap | Sodium soap prepared from hydrogenated tallow. |
| CN Soap | Monoethanolamine soap of coconut fatty acids. |
| TEA | Triethanolamine. |
| CS | Sodium cumene sulfonate. |
| TPP | Tetrasodium pyrophosphate. |
| EDTA | Tetrasodium salt of ethylenediamine tetraacetic acid. |
| NTA | Trisodium salt of nitrilotriacetic acid. |
| Dequest 2060 | Diethylenetriamine penta(methylene phosphonic acid), marketed by Monsanto. |
| Dequest 2041 | Ethylenediamine tetra(methylene phosphonic acid) marketed by Monsanto. |

EXAMPLES 1 TO 7

The following liquid compositions were prepared by mixing the ingredients in water:

| | 1 | 2 | 3 | 4 | 5 | 6 | 7 |
|---|---|---|---|---|---|---|---|
| PS | 4.5 | 4.0 | — | 8.0 | 5.0 | — | 6.0 |
| LAS | — | — | 4.0 | — | — | 4.0 | — |
| Dobanol 91-8 | 2.0 | — | — | — | — | 2.0 | 0.5 |
| TPP | — | — | — | — | 3.0 | — | — |
| Sodium citrate.$2H_2O$ | 3.5 | 3.5 | — | — | — | — | 8.0 |
| Sodium metasilicate | — | — | — | 3.0 | — | — | 1.0 |
| Sodium carbonate | 3.0 | 3.0 | 2.5 | — | — | — | — |
| EDTA | — | — | — | 2.5 | — | — | — |
| NTA | — | — | 3.0 | — | — | 6.0 | — |
| Orange terpenes | 2.0 | 2.0 | — | — | — | — | — |
| Dipentene | — | — | 2.0 | — | — | — | — |
| D-limonene | — | — | — | 6.0 | — | — | — |
| $\alpha$-pinene | — | — | — | — | 2.0 | — | — |
| $\beta$-pinene | — | — | — | — | — | 3.0 | — |
| Terpinolene | — | — | — | — | — | — | 2.0 |
| Benzyl alcohol | 2.0 | — | 2.0 | 6.0 | — | 1.5 | — |
| Hexyl Cellosolve | — | 3.0 | — | — | — | — | 2.0 |
| Ethylene HB-4 | — | — | — | — | 1.0 | — | — |
| Ethanol | — | — | — | 2.0 | — | — | — |
| Xanthan gum | — | — | — | — | 0.5 | — | — |
| CS | 2.0 | 2.0 | 2.0 | 3.0 | 3.5 | 2.0 | 2.0 |
| Water, Perfume & minors | | | | to 100 | | | |

The above compositions were homogenous fluent liquids having good stability, excellent surface-shine and cleaning characteristics on both inorganic particulate soils and oily/greasy soils with controlled sudsing in both dilute and concentrated usage under both hard and soft water conditions.

EXAMPLES 8 TO 13

| | 8 | 9 | 10 | 11 | 12 | 13 |
|---|---|---|---|---|---|---|
| PS | 4.5 | 8.0 | 4.0 | — | 5.0 | — |
| LAS | — | — | — | 5.0 | — | 6.0 |
| Dobanol 91-8 | 2.0 | — | — | 1.5 | 2.0 | 0.5 |
| TPP | — | — | — | 6.0 | — | — |
| Sodium citrate.$2H_2O$ | 3.5 | — | 3.0 | — | — | 3.0 |
| Sodium metasilicate | — | 3.0 | — | 1.0 | — | — |
| Sodium carbonate | 3.0 | — | 3.0 | — | — | — |
| EDTA | — | 2.5 | — | — | — | 0.5 |
| NTA | — | — | — | — | 6.0 | — |
| Orange terpene | — | — | 2.0 | — | — | — |
| Dipentene | — | 6.0 | — | — | — | — |
| D-limonene | 4.0 | — | — | — | — | — |
| α-pinene | — | — | — | 2.0 | — | — |
| β-pinene | — | — | — | — | — | 4.0 |
| Terpinolene | — | — | — | — | 3.0 | — |
| n-Butyl butyrate | 3.0 | — | — | — | 2.0 | — |
| Benzyl alcohol | — | 6.0 | 1.5 | — | — | — |
| Benzyl Cellosolve | — | — | — | 3.0 | — | 2.0 |
| CN Soap | 1.5 | 1.5 | 0.3 | 0.05 | — | — |
| HT Soap | — | — | — | — | 0.1 | 0.5 |
| Xanthan gum | — | — | 0.5 | — | — | — |
| Ethanol | — | 2 | — | — | — | 1.5 |
| TEA | 1.0 | 3.0 | — | — | — | 2.0 |
| CS | — | — | 2.0 | — | — | 1.0 |
| Water, Perfume & minors | | | To 100 | | | |

The above compositions were homogenous fluent liquids having good stability, excellent surface shine and cleaning characteristics on both inorganic particulate soils and oily/greasy soils with controlled sudsing in both dilute and concentrated usage under both hard and soft water conditions.

EXAMPLES 14 TO 20

| | 14 | 15 | 16 | 17 | 18 | 19 | 20 |
|---|---|---|---|---|---|---|---|
| PS | — | — | — | — | 2.0 | — | — |
| LAS | — | — | — | — | — | 1.0 | — |
| Dobanol 91-8 | 2.7 | 2.0 | 3.2 | 2.0 | 1.0 | — | — |
| Deriphat 170C | — | 5.0 | — | 2.5 | — | — | — |
| Amphoram CP1 | 3.2 | — | 3.2 | — | — | — | 5.0 |
| Deriphat 154 | — | — | — | 1.0 | 2.0 | 4.0 | — |
| CN Soap | — | — | — | — | — | 0.5 | — |
| Sodium citrate.$2H_2O$ | — | — | — | — | 6.0 | 8.0 | — |
| Sodium carbonate | 3.0 | — | 2.0 | — | — | — | — |
| Sodium metasilicate | — | — | — | — | 1.0 | — | 2.0 |
| TPP | — | 4.0 | — | — | — | — | — |
| EDTA | — | — | 2.5 | — | — | — | — |
| NTA | 3.0 | — | — | — | — | — | 4.0 |
| Dequest 2060 | — | — | — | — | 0.5 | — | — |
| Ethylene glycol dibutyl ether | 1.5 | — | — | — | 1.0 | — | — |
| Benzyl alcohol | — | 2.0 | — | 3.0 | — | 2.0 | — |
| Ethylan HB-4 | — | — | 1.0 | — | — | — | 2.0 |
| CS | — | 5.0 | — | 7.0 | — | 2.0 | — |
| Orange terpenes | — | — | 1.0 | — | — | 2.5 | — |
| Dipentene | — | — | — | — | 2.0 | — | — |
| D-limonene | 3.0 | — | — | — | — | — | — |
| α-pinene | — | 2.0 | — | — | — | — | — |
| β-pinene | — | — | — | — | — | — | 2.0 |
| Terpinolene | — | — | — | 5.0 | — | — | — |
| Ethanol | — | — | 1.0 | 2.0 | — | — | — |
| Water, Perfume & minors | | | | To 100 | | | |

The above compositions were homogeneous fluent liquids having good stability, excellent cleaning characteristics on both inorganic particulate soils and oily/greasy soils with controlled sudsing in both dilute and concentrated usage under both hard and soft water conditions.

EXAMPLES 21 TO 24

| | 21 | 22 | 23 | 24 |
|---|---|---|---|---|
| PS | 4.5 | 5.0 | 4.0 | 3.0 |
| LAS | — | — | 2.0 | — |
| Dobanol 91-8 | — | — | 0.5 | 3.0 |
| CN Soap | — | — | — | 0.5 |
| Sodium citrate.$2H_2O$ | 3.5 | 3.5 | — | 6.0 |
| Sodium carbonate | 3.0 | 2 | 6.0 | 1.0 |
| Pine oil | 2.0 | — | — | — |
| α-terpineol | — | 1.8 | — | — |
| Linalool | — | — | 2.2 | — |
| Geraniol | — | — | — | 2.5 |
| Benzyl alcohol | 1.5 | 1.5 | 4.0 | — |
| Phenyl ethyl alcohol | — | — | — | 2.5 |
| o-Phenyl phenate | 1.3 | 1.5 | 1.3 | 1.3 |
| CS | 1.4 | 1.5 | 1.0 | 2.0. |
| Water, Perfume and minors | | | To 100 | |

The above compositions were homogeneous, fluent liquids having good stability at both normal and low temperatures, as well as excellent germicidal activity, surface shine and cleaning performance on both inorganic particulate soils and oily/greasy soils.

What is claimed is:

1. An aqueous liquid detergent composition comprising:

(a) from 1% to 20% of surfactant selected from synthetic anionic, nonionic, amphoteric and zwitterionic surfactants and mixtures thereof, (b) from 0.5% to 10% of terpene selected from mono- and sesquiterpenes and mixtures thereof, the weight ratio of surfactant:terpene lying in the range from 5:1 to 1:3 and (c) from 0.5 to 10% of a polar solvent having a solubility in water at 25° C. in the range from 0.2% to 10%, said polar solvent being selected from the group consisting of benzyl alcohol, polyethoxylated phenols containing from 2 to 6 ethoxy groups, phenylethyl alcohol, mono $C_6$–$C_9$ alkyl ethers of ethylene glycol, di-$C_4$–$C_9$ alkyl ethers of ethylene glycol, and mixtures thereof.

2. A composition according to claim 1 wherein the terpene is a mono- or bicyclic monoterpene selected from the terpinenes, terpinolenes, limonenes, and pinenes and mixtures thereof.

3. A composition according to claim 2 wherein the terpene is selected from d-limonene, dipentene, α-pinene and β-pinene.

4. A composition according to claim 1 wherein the terpene is a terpene alcohol, terpene aldehyde or terpene ketone.

5. A composition according to claim 4 wherein the terpene is a terpene alcohol present in a level of from 1% to 3%.

6. A composition according to claim 5 wherein the terpene alcohol is present in a level of from 1.5% to 2.5%.

7. A composition according to claim 1, 2 or 4 wherein the polar solvent is benzyl alcohol.

8. A composition according to claim 7 wherein the weight ratio of terpene to polar solvent is in the range from 5:1 to 1:5.

9. A composition according to claim 1, 2 or 4 wherein the weight ratio of terpene to polar solvent is in the range from 5:1 to 1:5.

10. A composition according to claim 1 having a pH in 1% aqueous solution of at least 8.0, characterized by from 0.5% to 13% of a water-soluble inorganic or organic polyanionic sequestrant having a calcium ion stability constant at 25° C. of at least 2.0, the weight ratio of surfactant:sequestrant lying in the range from 5:1 to 1:3.

11. A composition according to claim 10 wherein the sequestrant is selected from the water-soluble salts of polyphosphates, polycarboxylates, amino poly-carboxylates, polyphosphonates and aminopolyphosphonates, the weight ratio of the surfactant:sequestrant lying in the range 3:1 to 1:1.

12. A composition according to claim 1, 2 or 4 wherein the polar solvent is ethyleneglycol dibutyl ether.

13. A composition according to claim 1 wherein the polar solvent is selected from the group consisting of benzyl alcohol, polyethoxylated phenols containing from 2 to 6 ethoxyl groups, phenylethyl alcohol, di-$C_4$–$C_9$ alkyl ethers of ethylene glycol, and mixtures thereof.

14. A composition according to claim 13 wherein the polar solvent is selected from the group consisting of benzyl alcohol, polyethoxylated phenols containing from 2 to 6 ethoxyl groups, phenylethyl alcohol and mixtures thereof.

15. A composition according to claim 13 wherein the polar solvent is di-$C_4$–$C_9$ alkyl ether of ethylene glycol.

16. A composition according to claim 1 comprising additionally from 0.005 to 2% of an alkali metal, ammonium or alkanolammonium soap of a $C_{13}$–$C_{24}$ fatty acid.

17. A composition according to claim 16 wherein the soap is present in an amount ranging from about 0.05% to about 0.7%.

18. A composition according to claim 17 wherein the polar solvent is benzyl alcohol.

19. A composition according to claim 17 wherein the polar solvent is ethylene glycol dibutyl ether.

20. A composition according to claim 1 which contains less than about 4% by weight of a hydrotrope selected from the group consisting of urea, monoethanolamine, diethanolamine and the sodium, potassium, ammonium and alkanol ammonium salts of xylene-, toluene-, ethylbenzene-, isopropylbenzene-sulfonates.

21. A composition according to claim 20 which is free of said hydrotrope.

22. A composition according to claim 21 wherein the polar solvent is benzyl alcohol.

23. A composition according to claim 21 wherein the polar solvent is ethyleneglycol dibutyl ether.

* * * * *